US005763043A

United States Patent [19]

Porter et al.

[11] Patent Number: 5,763,043

[45] Date of Patent: Jun. 9, 1998

[54] OPEN GRID FABRIC FOR REINFORCING WALL SYSTEMS, WALL SEGMENT PRODUCT AND METHODS OF MAKING SAME

[75] Inventors: John F. Porter, St. Catharines; Mark O. Kittson, Niagara Falls; Mark Tucker, Waubaushene; Larry Ferris; Steve LePage, both of Midland, all of Canada

[73] Assignee: Bay Mills Limited, St. Catharines, Canada

[21] Appl. No.: 87,263

[22] Filed: Jul. 8, 1993

Related U.S. Application Data

[63] Continuation-in-part of Ser. No. 976,642, Nov. 16, 1992, abandoned, which is a continuation of Ser. No. 861,166, Mar. 27, 1992, abandoned, which is a continuation of Ser. No. 548,240, Jul. 5, 1990, abandoned.

[51] Int. Cl.[6] ..... B32B 5/12

[52] U.S. Cl. ..... 428/109; 428/114; 428/137; 428/138; 428/297; 428/255; 52/309.16; 52/309.17; 52/DIG. 7

[58] Field of Search ..... 428/232, 294, 428/255, 109, 114, 130, 297; 52/309.7, 309.16, DIG. 7

[56] References Cited

U.S. PATENT DOCUMENTS

| | | | |
|---|---|---|---|
| 1,116,202 | 11/1914 | Assip . | |
| 2,064,785 | 12/1936 | Crandell | 72/16 |
| 2,313,990 | 3/1943 | Crandell | 72/16 |
| 3,389,518 | 6/1968 | Horbach | 52/309 |
| 3,391,037 | 7/1968 | McNulty | 156/71 |
| 3,455,077 | 7/1969 | Long | 52/459 |
| 3,576,091 | 4/1971 | Shull, Jr. et al. | 52/309 |
| 3,579,409 | 5/1971 | Shannon | 161/39 |
| 3,944,698 | 3/1976 | Dierks et al. | 428/219 |
| 3,949,111 | 4/1976 | Pelletier | 428/109 |
| 3,984,269 | 10/1976 | Schneller et al. | 156/71 |
| 3,993,822 | 11/1976 | Knauf et al. | 428/213 |
| 4,064,306 | 12/1977 | Scotchmer et al. | 428/255 |
| 4,108,708 | 8/1978 | Gregory et al. | 156/441 |
| 4,152,474 | 5/1979 | Cook, deceased et al. | 428/137 |
| 4,159,361 | 6/1979 | Schupack | 428/240 |
| 4,195,110 | 3/1980 | Dierks et al. | 428/218 |
| 4,242,406 | 12/1980 | El Bouhnini et al. | 428/236 |
| 4,277,527 | 7/1981 | Duhl | 428/109 |
| 4,298,413 | 11/1981 | Teare | 156/42 |
| 4,298,645 | 11/1981 | Obayashi et al. | 428/110 |
| 4,304,813 | 12/1981 | Elmore, Jr. | 428/253 |
| 4,320,160 | 3/1982 | Nishimura et al. | 428/107 |

(List continued on next page.)

FOREIGN PATENT DOCUMENTS

| | | |
|---|---|---|
| 365708 | 10/1982 | Austria . |
| 882081 | 9/1971 | Canada . |
| 106986 | 5/1984 | European Pat. Off. . |
| 0131954 | 1/1985 | European Pat. Off. . |
| 0290653 | 11/1988 | European Pat. Off. . |
| 0464803 | 1/1992 | European Pat. Off. . |
| 411138 | 12/1909 | France . |
| 1123266 | 8/1953 | Germany . |
| 3136026 | 3/1983 | Germany . |
| 9105045 | 6/1991 | Germany . |

*Primary Examiner*—Patrick J. Ryan
*Assistant Examiner*—J. M. Gray
*Attorney, Agent, or Firm*—Fitzpatrick, Cella, Harper & Scinto

[57] ABSTRACT

An open grid fabric for reinforcing wall systems and a method of making same. First and second sets of substantially parallel, selected rovings are combined using certain knits, leno weaves, or adhesive methods. The rovings are direct-sized with at least a silane sizing and preferably have a linear density between 100 and 2000 grams per thousand meters and are arranged at an average of 3 to 10 ends per inch. A polymeric coating is applied to the fabric at a level of 10 to 150 parts dry weight of resin to 100 parts by weight of the fabric while assuring that the open grid remains open. A method for reinforcing a wall system and a wall segment product utilizing the novel open grid fabric of the present invention are also disclosed.

27 Claims, 7 Drawing Sheets

U.S. PATENT DOCUMENTS

| | | | |
|---|---|---|---|
| 4,378,405 | 3/1983 | Pilgrim | 428/322.7 |
| 4,409,772 | 10/1983 | Boyack | 52/746 |
| 4,421,581 | 12/1983 | Olsen | 156/71 |
| 4,425,398 | 1/1984 | Berczi | 428/253 |
| 4,437,865 | 3/1984 | Parekh et al. | 51/298 |
| 4,450,022 | 5/1984 | Galer | 156/42 |
| 4,491,617 | 1/1985 | O'Connor et al. | 428/236 |
| 4,504,335 | 3/1985 | Galer | 150/42 |
| 4,522,004 | 6/1985 | Evans et al. | 52/409 |
| 4,525,970 | 7/1985 | Evans | 52/454 |
| 4,528,238 | 7/1985 | Alford | 428/246 |
| 4,539,254 | 9/1985 | O'Connor et al. | 428/236 |
| 4,578,915 | 4/1986 | Schneller | 52/309.12 |
| 4,615,934 | 10/1986 | Ellison | 428/254 |
| 4,636,428 | 1/1987 | Bruner et al. | 428/254 |
| 4,646,498 | 3/1987 | Schneller et al. | 52/309.12 |
| 4,647,496 | 3/1987 | Lehnert et al. | 428/251 |
| 4,699,542 | 10/1987 | Shoesmith | 404/82 |
| 4,762,744 | 8/1988 | Woiceshyn et al. | 428/219 |
| 4,780,350 | 10/1988 | O'Connor et al. | 428/109 |
| 4,816,091 | 3/1989 | Miller | 156/42 |
| 4,857,379 | 8/1989 | Plöntges et al. | 428/102 |
| 4,879,163 | 11/1989 | Woiceshyn | 428/198 |
| 4,948,658 | 8/1990 | Hälker | 428/234 |
| 4,957,390 | 9/1990 | Shoesmith | 404/70 |
| 4,989,529 | 2/1991 | Shoesmith | 112/261.1 |
| 5,057,172 | 10/1991 | Woiceshyn | 156/148 |
| 5,099,993 | 3/1992 | Lewington et al. | 206/409 |
| 5,238,728 | 8/1993 | Aucagne | 428/232 |
| 5,356,701 | 10/1994 | Wei et al. | 428/294 |

OPEN GRID FABRIC FOR REINFORCING WALL SYSTEMS, WALL SEGMENT PRODUCT AND METHODS OF MAKING SAME

This application is a continuation-in-part of application, Ser. No. 07/976,642, filed Nov. 16, 1992, abandoned; which is a continuation of application Ser. No. 07/861,166, filed Mar. 27, 1992, abandoned; which is a continuation of Ser. No. 07/548,240, filed Jul. 5, 1990, abandoned.

BACKGROUND OF THE INVENTION

1. Field of the Invention

This invention relates to fabrics for reinforcing stucco layers on walls, particularly on rigid foam insulation boards. Such fabrics are made in the form of a grid with openings between the strands. The fabrics are then coated with a resin which does not close the openings. The open grid fabric of this invention is made from certain selected rovings by weft insertion warp knitting, by certain weaving techniques, or by securing a laid, nonwoven grid together by adhesive alone. The present invention also relates to methods of making such reinforcement fabric, to methods for reinforcing such wall systems, and to wall segments that utilize the novel reinforcement disclosed herein.

2. Description of the Related Art

A popular method of constructing walls comprises a wall system in which a rigid plastic foam insulation board is bonded to a concrete or other wall. The insulation board is covered with a layer of reinforcement fabric, and thereafter a stucco or stucco-like material is applied to the fabric and board to embed and cover the fabric. The fabric may be initially attached to the insulation board mechanically with staples, nails, screws or the like. Alternatively, the fabric may be attached to the insulation board by means of an adhesive spread onto the insulation board. The stucco-like material, which is often referred to as a base coat, is typically a polymer modified cement containing, for example, Portland cement and an acrylic or other polymer or copolymer. During fabrication of the wall system, the fabric is buried in the stucco-like material. Openings in the fabric permit the stucco-like material to be pushed through the fabric and contact the insulation board. The stucco-like layer with reinforcement fabric buried in it may range from about 1/16 inch to 1/4 inch thick. Finally, a finishing coat is usually placed on top of the base coat to provide, among other things, better appearance and perhaps better weather resistance.

In such wall systems, a wall segment may be prepared either in situ on the outside of a building or in the form of prefabricated panels.

A primary purpose of the reinforcement fabric in these systems is to provide the wall with impact resistance for durability. The reinforcement fabric must, however, have several performance and application requirements: (1) the reinforcement should be economical; (2) the reinforcement should be as light in weight as possible; (3) the reinforcement should greatly increase the impact resistance of the wall system; (4) the reinforcement should provide some resistance to shrinkage cracking, which occasionally occurs in, for example, polymer modified cement stucco materials; (5) the fabric should confer vibration resistance to the wall; (6) performance of the reinforcement should not deteriorate significantly over an extended period; (7) for purposes of installation, the reinforcement should have applied thereto a resin which gives the reinforcement a "hand" or "limpness" to conform to changes in the profile of the wall (for example, at corners or bends), but the reinforcement should not be so limp as to "bunch up" or fold during trowelling of stucco thereon, nor should resin on the reinforcement be so soft that the fabric sticks to itself on a roll before installation (a phenomenon known as "blocking"); and (8) the reinforcement must have enough integrity to prevent distortion or dislodging of the yarns during handling and covering with stucco or stucco-like material. Numbers (7) and (8) refer to the pliability and body characteristics of the fabric that are important during application of the fabric and the stucco-like layer to the board and may be referred to as "application attributes."

Typically in the prior art, fabrics made of oil/starch sized yarns and coated with resins have been used as reinforcements in wall systems, but these fabrics have been woven fabrics, manufactured using conventional weaves, such as a plain weave with looper yarns, and conventional leno and hurl leno weaves. Nonwoven scrims of the kind held together solely by adhesive resin have also been used, but to a lesser extent. Leno weaving is a process in which warp or machine-direction yarns are arranged in pairs and the fill yarns (also referred to as weft or cross-machine yarns) extend across the fabric as in a plain weave, but the warp yarns are alternately twisted in a left hand and right hand direction, crossing before each weft yarn is inserted. FIGS. 1 and 2, in which the warp yarns are vertical, show examples of conventional leno weaves. FIG. 1 shows a regular leno weave, and FIG. 2 shows a hurl leno weave. FIG. 3 shows an example of a plain weave with looper yarns. As can be seen in the figures, these weaves provide an open grid, but in these weaves the warp strands are of equal yield (weight, volume, thickness, etc.) and tend to pinch the weft strands by a scissor action. We have found this can reduce penetration of the resin coating and decrease the impact resistance of the fabric. Also, such fabrics can become kinked or crimped during application.

Conventional reinforcements are generally referred to as "scrim" in U.S. Pat. No. 4,522,004, "woven glass fiber scrim" in U.S. Pat. No. 4,525,970, or "open-weave mesh" in U.S. Pat. No. 4,578,915.

Prior art wall system reinforcements using fabrics of the kinds shown in FIGS. 1 to 3 have typically been composed of fiberglass. Fiberglass yarn with oil/starch sizings have been used in the warp direction, while yarns with oil/starch sizing or rovings direct-sized with a silane sizing have been used for the fill or weft. The individual warp yarns are generally about one half the weight of the weft yarn or roving. In this way, the strength of each pair of warp yarns is comparable to that of the individual weft yarns or rovings.

Sizings, in general, refer to film forming resinous polymers that are applied to strands to provide additional smoothness, abrasion resistance and other properties. Conventional sizings include lubricants such as starch, wax, lacquer, oil and/or anti-static chemicals such as quaternized amines. Oil/starch sizings have been preferred for fiberglass for reinforcements for wall systems because they are inexpensive, they provide the best lubrication and properties for weaving, and they may be removed by rinsing or burning if need be. Silane sizings, however, are sometimes used on fiberglass yarns to be incorporated into fiberglass reinforced plastics (FRP's). While silane sizings are not as good for weaving and processing, unlike starch and other conventional sizings they are compatible with the plastics used in FRP's. (Fabrics for FRP's made from such silane-sized rovings, however, are tightly woven or closely knit fabrics, and they are not pre-coated with polymer resins to form a coated, semi-rigid, open grid, as in the present invention.) Silane sizings may be applied directly to the roving before weaving or similar processing. Rovings made in this way may be referred to as direct-sized with a silane sizing. Generally, the exact compositions of "silane sizings" are kept secret by fiberglass manufacturers. Silane sizings are understood, however, to contain mainly silanes, since starches, oils and waxes may be incompatible with FRP plastics. Some silane sizings are a combination of a silane sizing and another sizing.

We have discovered, however, that it is possible to achieve results comparable to or better than those achieved by the prior art but using significantly less weight of yarn in the fabric, with consequent economies and reduced weight in the final wall. Alternatively, with the reinforcement of our invention, at comparable weight and cost, one is able to achieve significantly greater strength, durability and impact resistance.

Accordingly, it is one object of the present invention to produce an improved open grid fabric for reinforcing wall systems.

It is another object to reinforce a wall system and to provide a wall segment that utilizes the improved open grid fabric of the present invention.

These and other objects that will become apparent may be better understood by the detailed description provided below.

SUMMARY OF THE PRESENT INVENTION

The reinforcement fabric of the present invention comprises two sets of substantially parallel rovings at a substantial angle to each other. For example, rovings may be used in both the warp and the weft directions. The rovings in each of the two sets are direct-sized with at least a silane sizing, and they have a linear density between 33 and 2200 grams per thousand meters. The rovings in each set are arranged side by side at an average of 1.5 to 12 ends per inch. These two sets of rovings are combined or arranged next to each other, without compressing or pinching the rovings of one set between the rovings of the other set, to form an open grid weighing between 50 and 650 grams per square meter. This fabric is then coated with a polymeric resin to a level of 10 to 150 parts dry weight of resin to 100 parts by weight of the fabric while maintaining the openings in the grid.

One of the differences between the present invention and the prior art is the use of rovings in the warp, or machine-direction. Rovings are not easy to handle in the warp. In contrast to conventionally used yarns, which are twisted and hold their filaments close together, the filaments of zero-twist rovings have a tendency during fabrication, particularly fabrication into an open grid, to catch on the machinery, to become entangled, and/or to break off, creating loose ends and fuzziness in the final product and other problems. Also, rovings are typically sold in large, difficult to handle packages which do not fit onto conventional knitting, weaving and other equipment which are designed for the conventionally smaller packages of yarn.

Another difference between the present invention and the prior art is the use of a direct-sized silane sizing. Typically in fabrication of prior art grids for use as wall reinforcements, oil-starch sizings were used because they are inexpensive and give the best lubrication and other properties for weaving. We have learned, however, that while silane sizing may be more difficult to weave, rovings with silane sizing provide, in combination with the other elements of the invention, a better final wall reinforcement product, as discussed below.

Other differences between the present invention and the prior art are embodied in the particular fabric constructions and resins described herein, which in combination with the rovings and the sizings described, provide a better wall reinforcement product.

In making the reinforcement of this invention, a first set of substantially parallel rovings running in a first direction (for example, in the machine-direction), and a second set of substantially parallel rovings running in a second direction (for example, the cross-machine direction), are arranged at a substantial angle to one another without compressing or pinching rovings in one set between rovings in the other set.

As used herein, the term "rovings" refers to lightweight bundles of filaments that have substantially no twist, whether made directly from molten glass or not. The rovings of this invention are not sized with conventional oil/starch sizings. Instead, they are direct-sized with at least a silane sizing. As used herein, the phrase "direct-sized with at least a silane sizing" is used to refer to any sizing or its equivalent that is applied to a roving sold by the fiberglass manufacturer as being compatible with the plastics used in FRP's. Other chemicals in addition to silanes can be included in the sizing for other reasons, as known in the art.

The first and second sets of rovings may be affixed together by (1) weft insertion warp knitting loosely with tie yarn, (2) certain kinds of leno weaving with tie yarn, (3) holding a nonwoven scrim together and then securing it as a grid by adhesives alone, or (4) by equivalent methods to form an open grid fabric.

After formation of the open grid, polymeric resin is applied to the rovings at a level of 5 to 150 parts dry weight of resin to 100 parts by weight of the fabric. That is, resin is applied at 5% to 150% DPU (dry-weight pick up). The exact amount of resin applied depends on the physical properties of the resin and the desired physical characteristics of the reinforcement, while the spaces between the strands of the grid remain open. If the grid is a non-woven material held together by a polymer coating alone—that is, without the use of tie yarn—the resin level is typically in the high end of the DPU range referred to above—that is, 50 to 150 DPU.

The resulting reinforcement is a high strength, alkali resistant and impact resistant, resin-bearing open grid fabric including first and second sets of substantially parallel strands, which are direct-sized with at least a silane sizing and affixed together at a substantial angle to one another. The resulting reinforcement also may have a soft or pliable hand.

The present invention is also directed to annexing or securing the reinforcement to a wall surface and applying a layer of a stucco-like mixture to fill openings in the grid and to cover the grid. The invention may be used in situ or in prefabricated wall segments. In a wall segment, the invention may be embedded in a stucco-like coating mixture layer and combined with a rigid insulation board. In this embodiment, the mixture and reinforcement are affixed to the board. "Stucco" is used in this specification to include any stucco-like material or coating such as polymer modified cements currently used in the reinforced wall systems referred to above.

The fabric of this invention exhibits superior performance and ease of application at a lower cost as compared to prior reinforcements for wall systems.

BRIEF DESCRIPTION OF THE DRAWINGS

Throughout the figures the same reference numerals designate the same or corresponding parts.

DETAILED DESCRIPTION OF THE INVENTION

Figure 1:
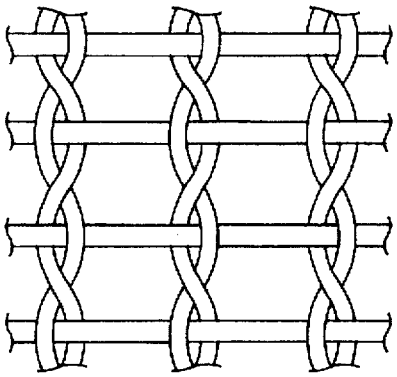
FIG. 1 shows a perspective view of a regular leno woven fabric according to the prior art.

The fabrics of the present invention all comprise an open grid of special construction patterns, and their equivalents, made from rovings that have been direct-sized with a sizing that contains a silane sizing.

In the present invention, rovings being direct sized with at least a silane sizing are used. For example, silane sizing may be used in an amount of approximately 2 to 3% by weight of the roving. Such direct-sized rovings are available from CertainTeed, Owens Corning Fiberglass, Fiberglas Canada, Inc., and PPG, for example. It has been found in the present invention that impact resistance may be increased when using strands direct-sized with at least a silane sizing.

The strands of the open grid fabric of the invention are "pre-coated." "Pre-coating" refers to the application of resin to the rovings of the grid after the fabric is made but before the grid is embedded in the stucco-like layer. The use of the word "coated" does not preclude penetration of the resin into the strands of the open grid, but openings between the rovings of the grid are not closed in the pre-coating. The particular resin must be chosen for compatibility with (1) the particular rovings and (2) the sizings or finishes on those strands, and for the desired properties during application and in the final wall system. The resin confers properties to the reinforcement fabric such as stability, alkali resistance, strength improvement, impact resistance and application attributes.

The glass transition temperature of the pre-coating resin is important to the present invention for providing the desirable hand to the fabric. A pliable hand is preferred. However, a fabric having an overly soft hand has the tendency to stick to itself on a roll. This is known as blocking. In the present invention, for any given weight of strands "hand" is primarily determined by the glass transition temperature characteristics of resin applied to the reinforcement. The glass transition temperature of the resin of the present invention is typically in the range of −30° C. to +20° C., but may extend from −40° C. to +40° C. The resin selected is preferably flame retardant. It is also preferable to use alkali and water resistant resins, such as those consisting of polyvinyl chloride, polyvinylidene chloride, styrene butadiene rubber, urethane, silicone, acrylic and styrene acrylate polymers and copolymers.

Polymeric resin is applied to the strands at a level of 5 to 150 parts dry weight of resin to 100 parts by weight of the fabric. That is, resin is applied at 5% to 150% DPU (dry-weight pick up). The amount of resin to be applied depends on the physical properties of the resin. One having skill in the art will understand that and select the properties and applied amounts of the polymeric resin to assure the desired physical characteristics of the reinforcement, while assuring that the openings in the grid remain open. This can be achieved by varying the solids to liquids content and by appropriate selection of the type of surfactant or the chemical and physical properties of the solids and liquids.

Figure 2:
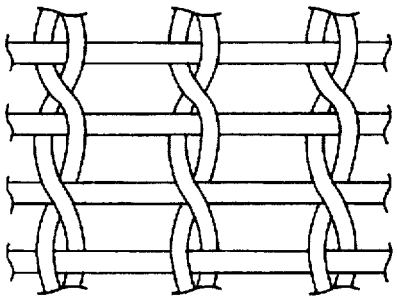
FIG. 2 is a perspective view of a regular hurl leno woven fabric according to the prior art.
Figure 4A:
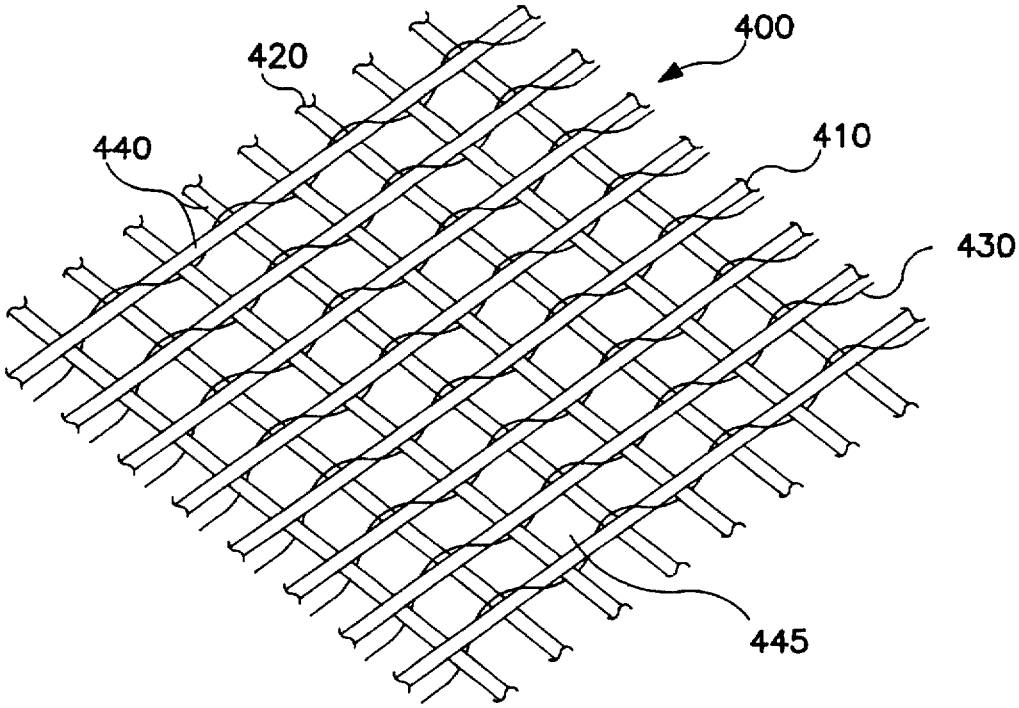
FIG. 4A is a perspective view of a weft inserted warp knit fabric of the present invention.

In the weft inserted, warp knit embodiment of the present invention shown in FIG. 4A, the most preferred resin amount to use is 10 to 40 DPU, and 10 to 80 DPU is less preferred. Also, the preferred resins to use are polyvinyl chloride, polyvinylidene chloride, styrene butadiene rubber, acrylics and acrylates. The resin, when applied in or above the preferred range of 25 to 40% dry weight pick-up, increases integrity of the open grid fabric by preventing strand-to-strand slippage and assists the fabric in resisting alkali damage. We have also found that resins, when used in the preferred range (i.e., about double the amount used on standard woven reinforcements of FIGS. 1 and 2), improve impact resistance by spreading the force of the impact out among adjoining structural strands. Weights of resin from 80 to 150 DPU are also possible, though economics may become a factor when such large amounts are used.

In FIG. 4A the open grid fabric 400 occupies essentially two planes. The warp or machine direction rovings 410 occupy and define one plane, and the weft or cross-machine direction rovings 420 occupy and define a second plane.

Warp rovings 410 and weft rovings 420 have been direct-sized with at least a silane sizing. That is, the strands are direct-sized with a coupling agent that includes at least a silane sizing.

The warp rovings 410 and weft rovings 420 are tied together in a knitting process in which the tie (or knitting) yarns 430 are lightweight flexible yarns wrapping the warp rovings and capturing the weft rovings. FIG. 4A is not intended to show precisely the path of tie yarn 430. The exact paths possible, which will vary depending on the machine and stitch used, are known to those of skill in the knitting art. If desired, more than two layers of rovings can be loosely affixed together by the tie yarns 430.

The rovings of the open grid fabric 400 (FIG. 4A) are further locked together by a polymeric resin 440.

Figure 3:
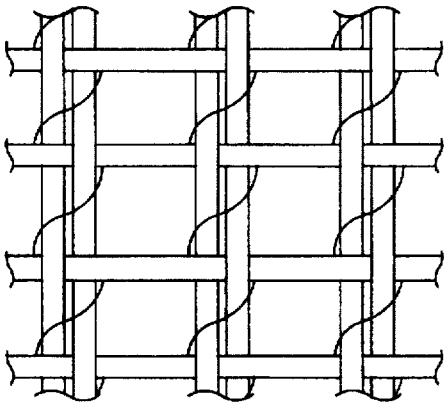
FIG. 3 is a perspective view of a plain woven fabric with looper yarns according to the prior art.

The two-plane construction of the reinforcement fabric of FIG. 4A minimizes the crimp or bending of the strands, which is an advantage over prior art reinforcements in which the strands can be kinked or crimped in standard woven construction. This construction also avoids the rovings of one set of strands being pinched or compressed between the rovings of the second set, as in the prior art, FIGS. 1 to 3. In addition, minimal crimp, which may be combined with loose tensioning, allows better penetration of the polymeric resin 440 into the strands in both the machine and cross-machine directions, while maintaining open openings 445 in the fabric 400.

An example of the construction of the fabric shown in FIG. 4A is a weft inserted warp knit product having approximately six ends per inch in both the warp and weft directions, but possibly as few as 1.5 ends in each direction and as many as 12 ends in each direction. Preferably, the ends of the first and the second sets are arranged in each set at an average of 3 to 10 ends per inch.

The warp and weft strands of open grid fabric 400 may have a linear density of 33 to 2200 Tex (grams per thousand meters). Preferably, the strands of the first set and the second set have a linear density between 100 and 2000 Tex and most preferably, 130 to 400 Tex. The weight and strength of the strands selected depends on the performance range desired. Certain features of the particular strands, including filament diameter, may be selected by those of skill in the art in accordance with the desired properties for the particular end use. Although fiberglass strands are preferred, others such as nylon, aramid, polyolefin and polyester may be used in various combinations.

As shown in FIG. 4A, the ends of the first set 410 and the ends of the second set 420 are arranged in an overlying relation and at a substantial angle to one another. This angle may be on the order of ninety degrees. However, it is not necessary to orient the ends of the first and second sets orthogonally. Rather, this angle may vary between sixty and one hundred twenty degrees or more.

The tie yarn 430, which is typically low weight polyester in the linear density range of 40 to 250 dTex, may preferably be knit in a chain stitch. However, other stitches such as a tricot stitch may be used. Other suitable tie yarns may be glass, cotton, nylon, olefin, acrylic, modacrylic, rayon, acetate, polyvinyl chloride, polyvinyl dichloride, or polyvinyl difluoride, for example. Organic or inorganic fibers may be used as desired.

In the open grid fabric shown in FIG. 4A, knitting is preferably done with a chain stitch and a loose tension on the tie yarn 430. A preferable loose tension for fabrics with a preferable number of ends per inch (4 to 8 ends in the cross-machine direction) and with a preferable weight of structural yarns (130 to 400 Tex), is at least about 3.1 yards of tie yarn for every one yard of ends 410 in the warp direction. A standard tension with this kind of fabric is about 3 yards of tie yarn for every one yard of ends 410 in the warp direction. If one increases this ratio to 3.1 to 1 the result is essentially no tension, or as little tension as possible without creating open loops in the knitting yarns, which may occur at a ratio of 3.3 to 1. This loose knitting is believed to be important because it permits the polymer resin when applied in later processing to penetrate the warp strands more uniformly and deeply. Breakage of warp strands was frequently a source of failure in prior wall systems.

As will be appreciated by those of skill in the art, one may adjust the various process variables, both in knitting and in applying resin, to alter the performance and processability of the final fabric. For example, using a loose tie yarn tension in the knitting process and using contact drying following the resin applied process, will render the fabric thinner than otherwise and improve the "hand" or suppleness of the fabric.

Figure 4B:
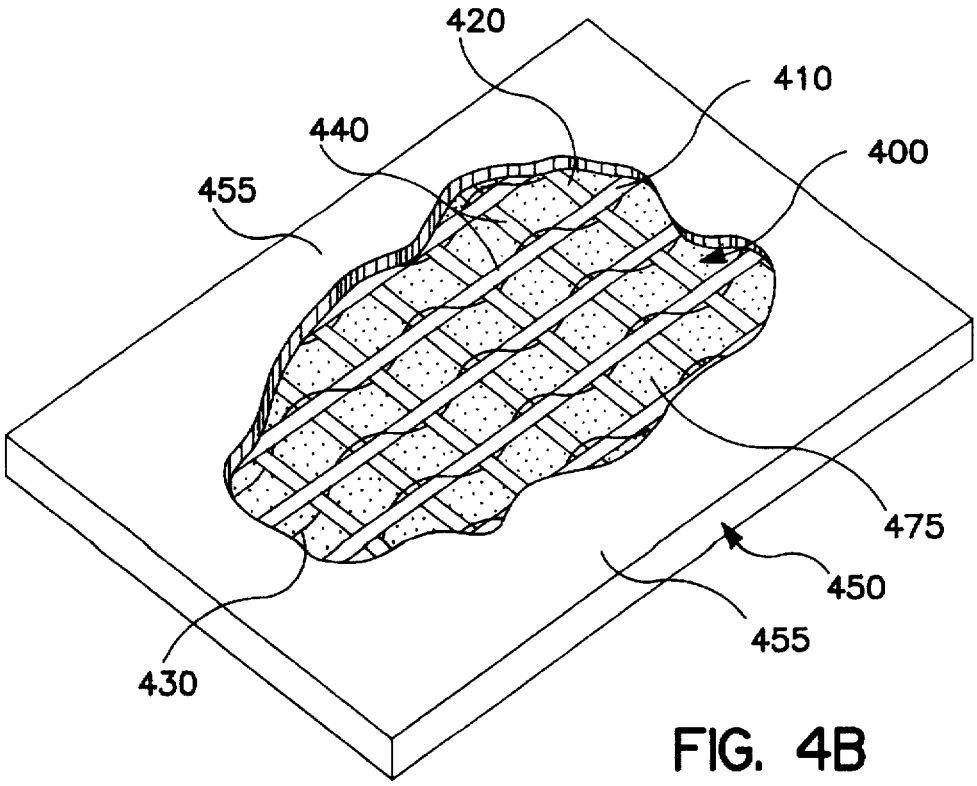
FIG. 4B is a perspective partial cut-away view of a wall segment produced using the weft inserted warp knit reinforcement fabric of the present invention.

FIG. 4B shows a wall segment product 450 that includes the reinforcement fabric 400 of the present invention. As discussed above, the reinforcement fabric 400 is a high strength, alkali and impact resistant, resin coated open grid of weft inserted warp knit fabric. The strands in both the warp direction 410 and weft direction 420 have been direct-sized with at least a silane sizing. The two sets of strands are affixed together at a substantial angle to one another by loosely tensioned tie yarns 430 in the manner discussed above. The polymeric resin 440 coats the open grid reinforcement fabric without closing openings 445 (see FIG. 4A) between the strands.

The open grid reinforcement fabric 400 is embedded in a stucco or stucco-like coating mixture 455. The coating mixture 455 is affixed to a rigid insulation board 475 by penetrating the openings between the strands of the open grid and filling the openings in the open grid to cover the reinforcement fabric to form the wall segment product 450.

FIG. 5A through FIG. 9B show other alternative embodiments of the open grid reinforcement fabric for wall systems of the present invention.

In FIGS. 5A through 8B, the open grid fabric is made by weaving, and in particular by leno weaving. These weaves differ from conventional leno weaves, however, in that one strand of the pair that lies in the machine direction (the warp) is much lighter than the other. This lighter strand may be referred to as a "tie yarn" because it ties the heavier machine direction strand to the cross machine strands (the weft), and we refer to these weaves as leno weaves with a tie yarn. Because of the differences in weight and volume, the tie yarn is less stiff than its heavier partner. If the tie yarn is polyester and the heavy roving is fiberglass, the difference in stiffness is increased. In such weaves, the heavier strand is straighter than the lighter one, and all of the heavier strands of one set of strands lie generally in one plane. Further, in the embodiments of FIGS. 5A through 8B, the warp direction strands remain substantially straight and free from crimp, while the lighter weight tie yarn will accept crimp readily. Also, in the weaves shown in these figures the rovings of one set do not pinch or compress the rovings of the other, as in the prior art. (See FIGS. 1–3). In addition, we have found that minimal crimp and freedom from compression allows better penetration of the polymeric resin into the strands in both the machine and cross-machine directions, while maintaining open openings in the fabric.

FIGS. 5A through 8B are not intended to show every possible path of the tie yarn or every possible weaving pattern. Alternative possible paths, which will vary depending on the machine and the rovings used, are known to those of skill in the art for other fabrics. Also, if desired, more than two layers of strands can be affixed together by the tie yarns.

Figure 5A:
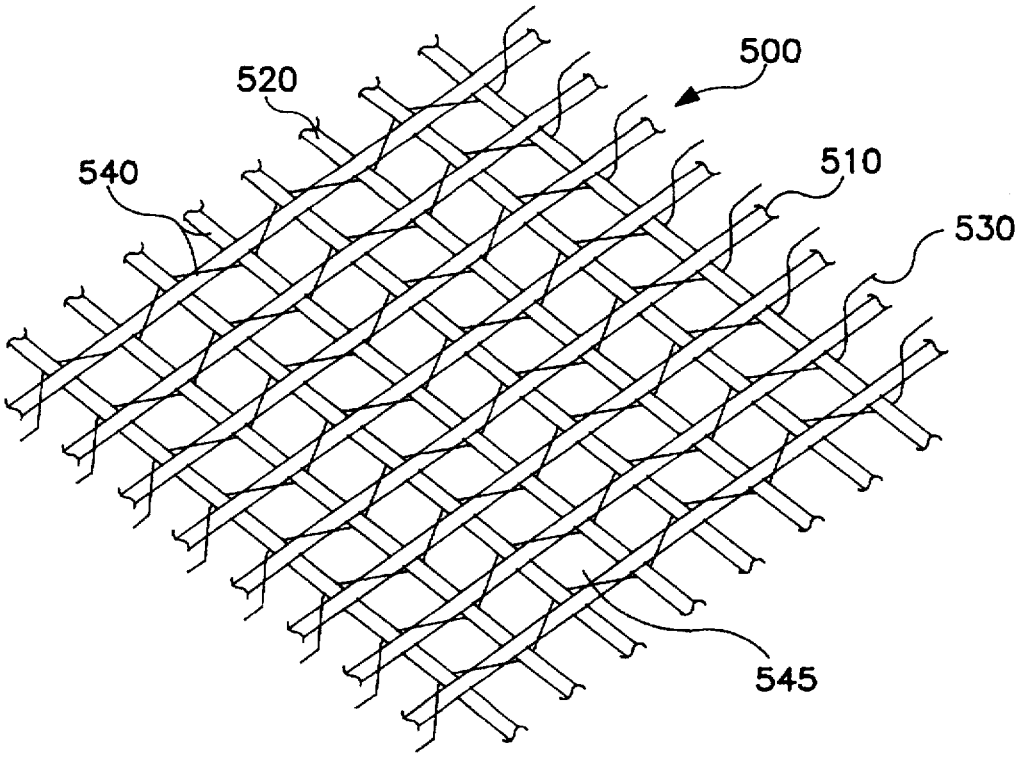
FIG. 5A is a perspective view of a woven fabric of the present invention having a leno weave.

FIG. 5A is a perspective view of a woven fabric 500 in an embodiment having a leno weave. As in the weft inserted warp knit embodiment, the open grid fabric 500 essentially occupies two planes. The warp or machine direction rovings 510 occupy and define one plane, and the weft or cross-machine direction rovings 520 occupy and define a second plane. These rovings have been direct-sized with at least a silane sizing and are tied together in a weaving process in which the tie yarns 530 are lightweight flexible yarns wrapping the warp strands and capturing the weft rovings.

In FIG. 5A, the ends of the first set 510 and the ends of the second set 520 are arranged in an overlying relation at a substantial angle to one another. The two-plane construction of the reinforcement of FIG. 5A reduces the crimp or bending of the strands, which is an advantage over standard woven reinforcements in which the weft rovings can be pinched, and kinked or crimped.

In FIG. 5A, the open grid fabric 500 is further locked together by polymeric resin 540, which confers properties to the reinforcement fabric such as stability, alkali resistance and strength improvement, in the manner discussed above, while assuring that the grid remains open.

Figure 5B:
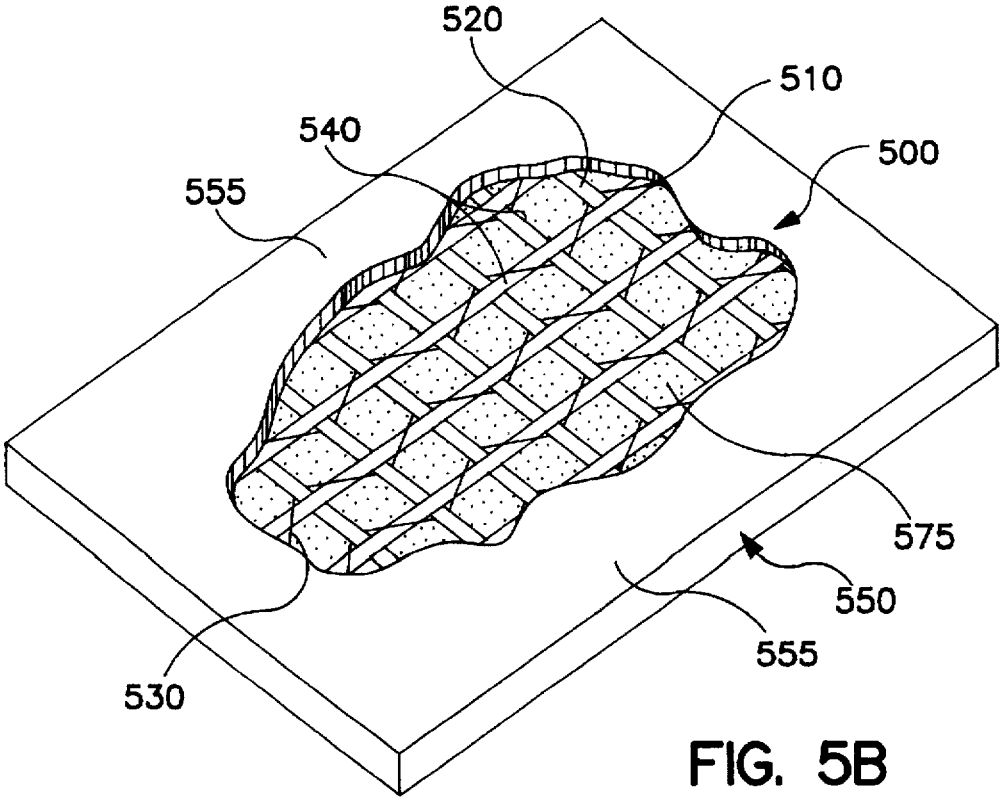
FIG. 5B is a perspective partial cut-away view of a wall segment produced using the leno woven fabric of the present invention.

FIG. 5B is a perspective partial cut-away view of wall segment 550 using the woven fabric 500. The open grid reinforcement fabric 500 is embedded in a stucco or stucco-like coating mixture 555. The coating mixture 555 is affixed to a rigid insulation board 575 by penetrating and filling the openings between the strands of the open grid to cover the reinforcement fabric to form the wall segment product 550.

Figure 6A:
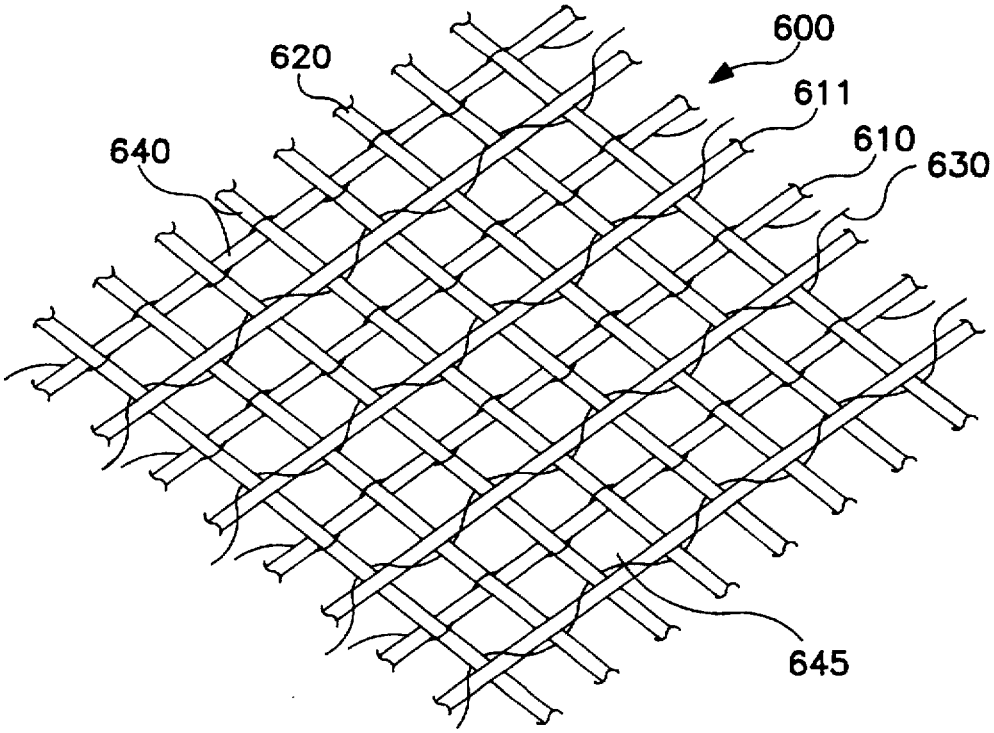
FIG. 6A is a perspective view of a woven fabric of the present invention having a staggered leno weave.

FIG. 6A is a perspective view of a woven fabric 600 in an embodiment having a staggered leno weave, which is the most preferred embodiment of the leno weaves. In FIG. 6A, the open grid fabric 600 essentially occupies three planes. Alternating sets of warp rovings 610 occupy and define one plane, adjacent alternating sets of warp rovings 611 occupy and define another plane, and the weft rovings 620 occupy and define a third plane. These rovings are direct-sized with at least a silane sizing and are tied together in a weaving process in which the tie yarns 630 wrap the warp rovings and capture the weft rovings.

The open grid fabric 600 is further locked together by a polymeric resin 640. The polymeric resin 640 is applied to the yarns at a level to assure the desired physical characteristics of the reinforcement discussed above, while assuring that the grid remains open. The three-plane construction of the reinforcement of FIG. 6A reduces the crimp or bending of the strands, which is an advantage over standard woven reinforcements. As discussed above, minimal pinching and crimp also assists in application and penetration of the polymeric resin 640.

Figure 6B:
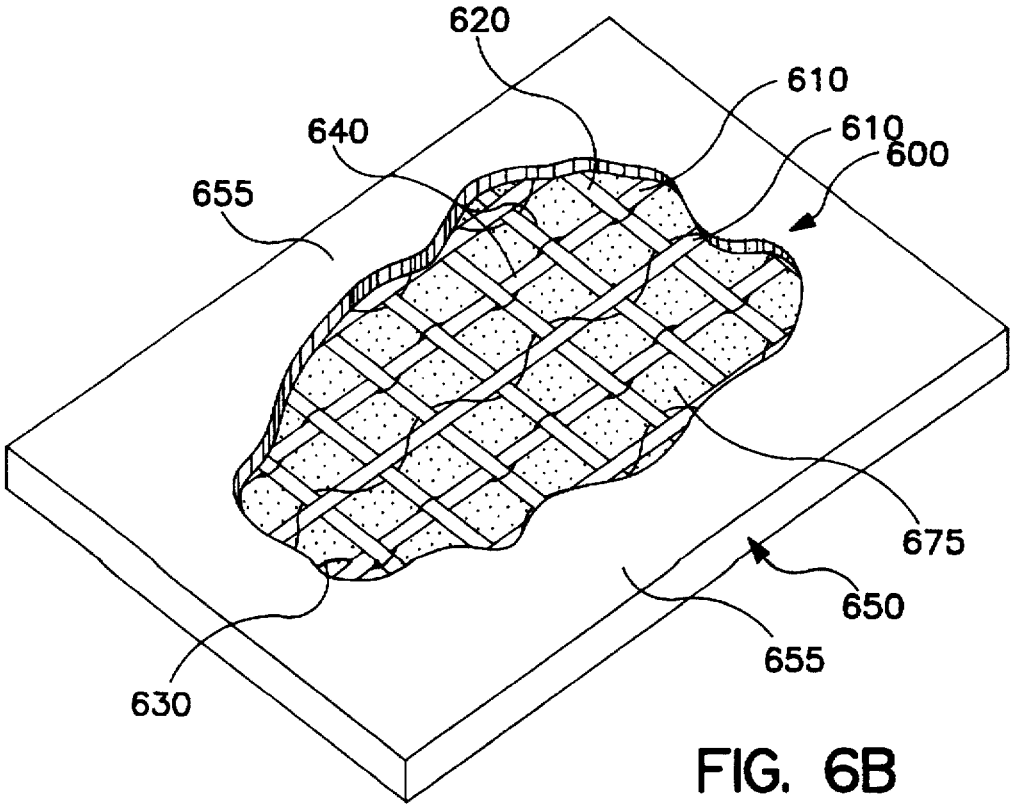
FIG. 6B is a perspective partial cut-away view of a wall segment produced using the staggered leno woven fabric of the present invention.

FIG. 6B is a perspective partial cut-away view of wall segment product 650 using the woven fabric 600. The open grid reinforcement fabric 600 is embedded in a stucco or stucco-like coating layer mixture 655. The coating mixture 655 is affixed to a rigid insulation board 675 by penetrating and filling the openings between the rovings of the open grid to cover the reinforcement fabric to form the wall segment product 650.

Figure 7A:
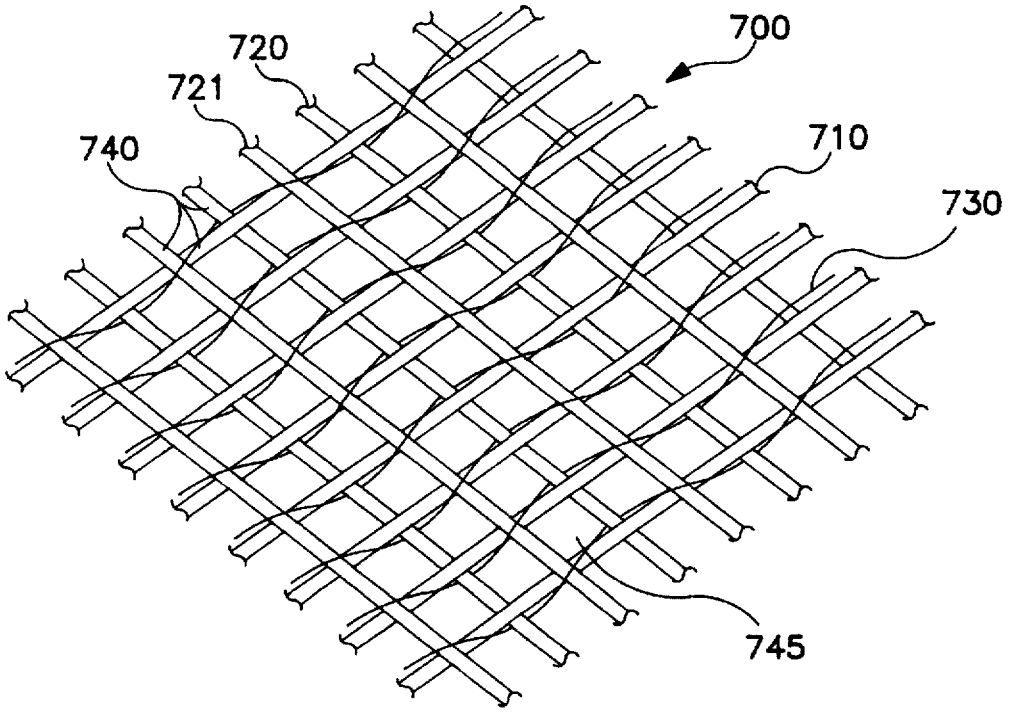
FIG. 7A is a perspective view of a woven fabric of the present invention having a hurl weave.

FIG. 7A is a perspective view of a woven fabric 700 in an embodiment having a hurl leno weave. As in the embodiment shown in FIG. 6A, the open grid fabric 700 essentially occupies three planes. However, in FIG. 7A, the warp rovings 710 occupy and define one plane, sets of alternating weft rovings 720 occupy and define a second plane, and adjacent alternating sets of weft rovings 721 occupy and define a third plane. These rovings are direct-sized with at least a silane sizing and are tied together in a weaving process in which the tie yarns 730 wrap the warp strands and capture the weft strands. The open grid fabric 700 is further locked together by polymeric resin 740.

As with the embodiment of FIG. 6A, the three-plane construction of the reinforcement of FIG. 7A reduces the pinching and crimp or bending of the strands, which is an advantage over standard woven reinforcements.

Figure 7B:
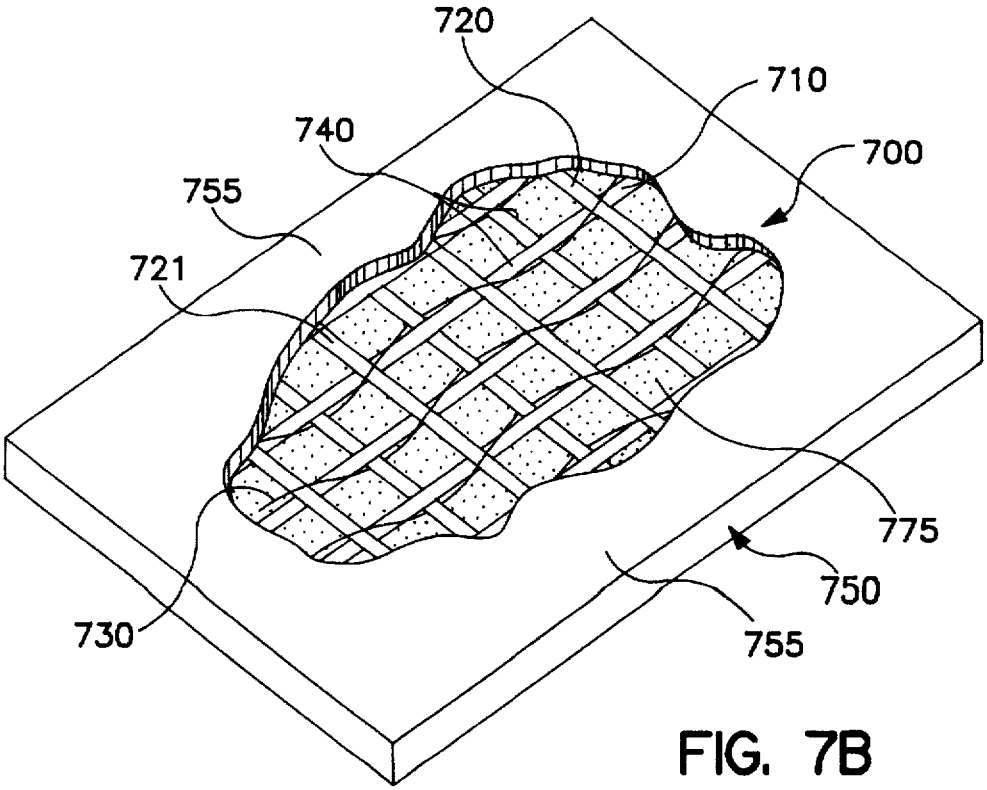
FIG. 7B is a perspective partial cut-away view of a wall segment produced using the hurl woven fabric of the present invention.

FIG. 7B is a perspective partial cut-away view of wall segment 750 using the woven fabric 700. The open grid reinforcement fabric 700 is embedded in a stucco or stucco-like coating mixture 755. The coating mixture 755 is affixed to a rigid insulation board 775 by penetrating and filling the openings between the strands of the open grid to cover the reinforcement fabric to form the wall segment product 750.

Figure 8A:
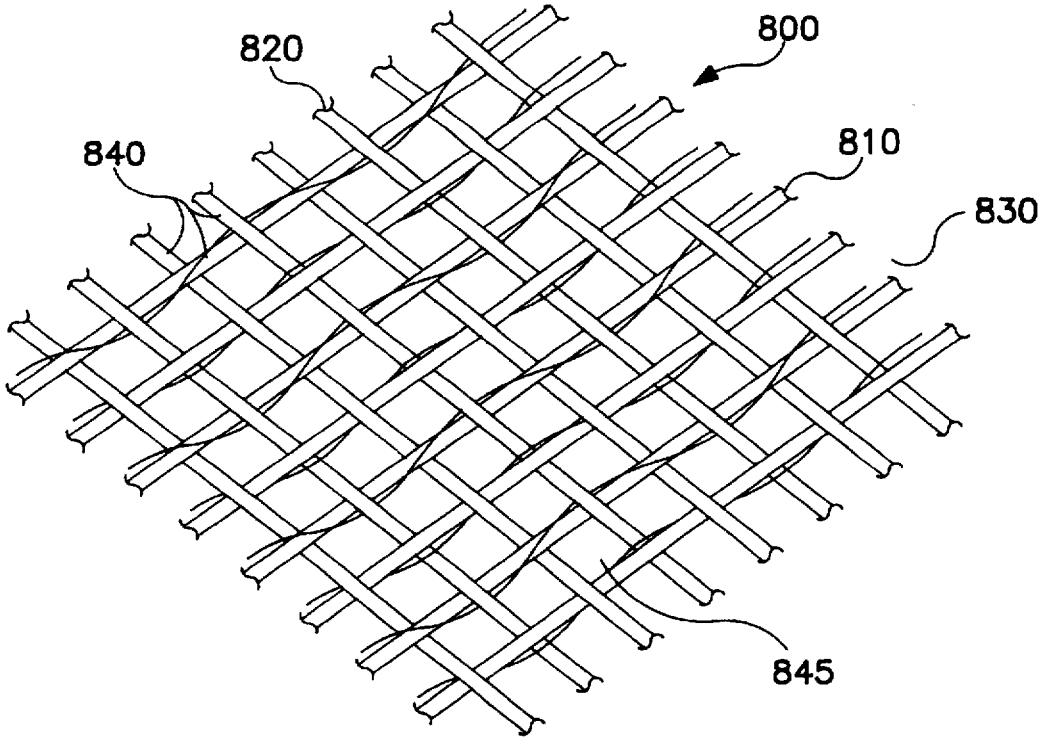
FIG. 8A is a perspective view of a woven fabric of the present invention having a staggered hurl leno weave.

FIG. 8A is a perspective view of a woven fabric 800 embodiment having a staggered hurl leno weave. In FIG. 8A, the warp direction rovings 810 are interlaced with the weft direction rovings 820. These rovings have been direct-sized with at least a silane sizing and are tied together in a weaving process in which the tie yarns 830 wrap the warp strands and capture the weft strands. The open grid fabric 800 is further locked together by a polymeric resin 840.

An interesting feature in the embodiments of FIGS. 6A, 7A and 8A is that the woven fabric 600, 700, 800 has no face. That is, the fabric has the same appearance and characteristics on both sides. This provides for ease of installation, among other advantages.

The interlaced construction of the open grid reinforcement of FIG. 8A reduces the pinch, and crimp or bending of the strands, which is an advantage over conventional weaves and allows better penetration of the polymeric resin 840.

Figure 8B:
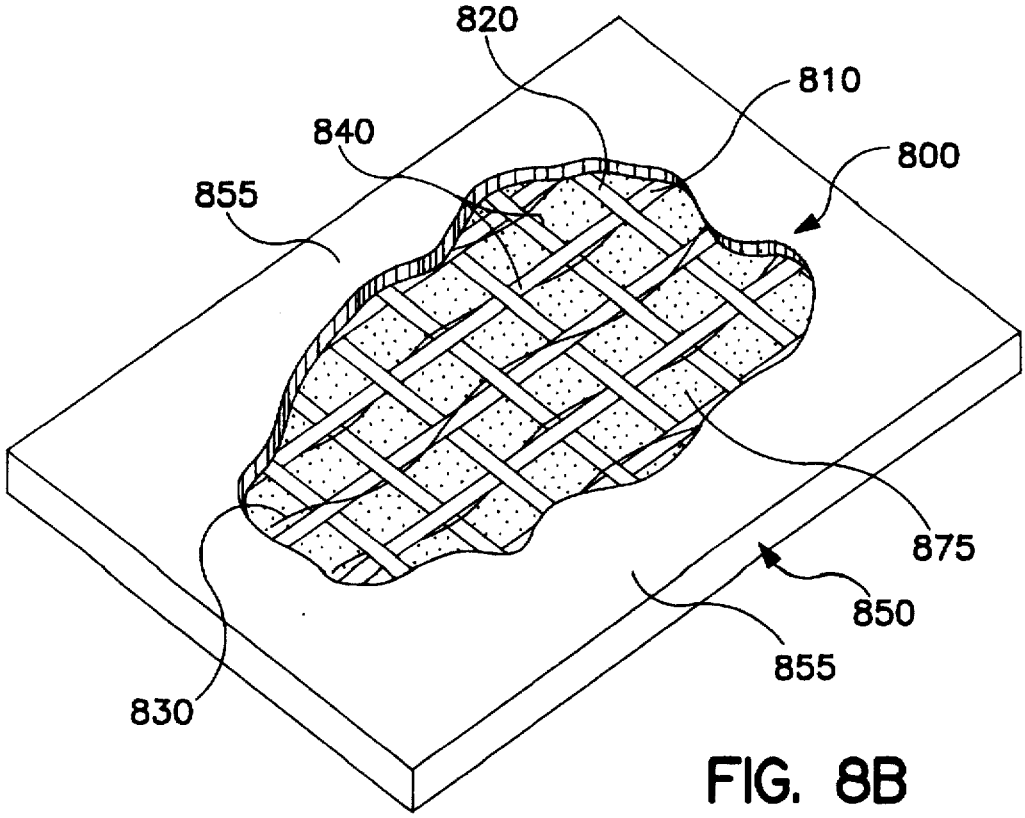
FIG. 8B is a perspective partial cut-away view of a wall segment produced using the staggered hurl leno weave fabric of the present invention.

FIG. 8B is a perspective partial cut-away view of wall segment 850 using the woven fabric 800. The open grid reinforcement fabric 800 is embedded in a stucco or stucco-like coating mixture 855. The coating mixture 855 is affixed to a rigid insulation board 875 by penetrating and filling the openings between the strands of the open grid to cover the reinforcement fabric to form the wall segment product 850.

For example, the fabrics shown in FIGS. 5A through 8B may have approximately six ends per inch in both the warp and weft directions, but possibly as few as 1.5 ends in each direction and as many as 12 ends in each direction. Preferably, the ends of the first and second sets are arranged in each set at an average of 3 to 10 ends per inch. The ends in the weft direction need not be the same as the ends in the warp direction.

In FIGS. 5A through 8B, the warp and weft rovings of the open grid fabric may have a linear density of 5 to 4000 Tex (grams per thousand meters). Preferably, the strands of the first set and the second set have a linear density between 33 and 2200 Tex and most preferably, 130 to 400 Tex. It is especially preferred to use roving or zero to no twist yarn on the order of 275 Tex in both the warp and weft directions. However, the weight and strength of the strands selected depends on the performance range desired. Although fiberglass strands are preferred, others such as nylon, aramid, polyolefin and polyester may be used in various combinations.

In FIGS. 5A through 8B, the tie yarn (530 in FIG. 5A) is typically a low weight polyester tie yarn in the linear density range of 40 to 250 dTex. Also, other suitable tie yarns may be glass, cotton, nylon, olefin, acrylic, modacrylic, rayon, acetate, polyvinyl chloride, polyvinyl dichloride, or polyvinyl difluoride, for example. Other suitable organic or inorganic fibers may also be used.

In each of the embodiments shown in FIGS. 4A through 9B, the ends of the first and second sets of strands are arranged in one of an overlying and an interlacing relation at a substantial angle to one another. This angle may be on the order of 90 degrees. However, it is not necessary to orient the ends of the first and second sets orthogonally. Rather, this angle may vary between 60 and 120 degrees or more.

In the embodiments of FIGS. 5A through 8B, polymeric resin (for example, 540) is applied to the strands at a level of 10 percent to 150 percent DPU (dry-weight pick up). The level of resin applied depends on the physical properties of the resin and is selected to assure the desired physical characteristics of the reinforcement, while assuring that the openings in the grid remain open. The most preferred resin amount to use is 10 to 40 DPU, and 10 to 80 DPU is less preferred. Weights of resin above 80 DPU are also possible, though economics becomes a factor when such large amounts are used.

Figure 9A:
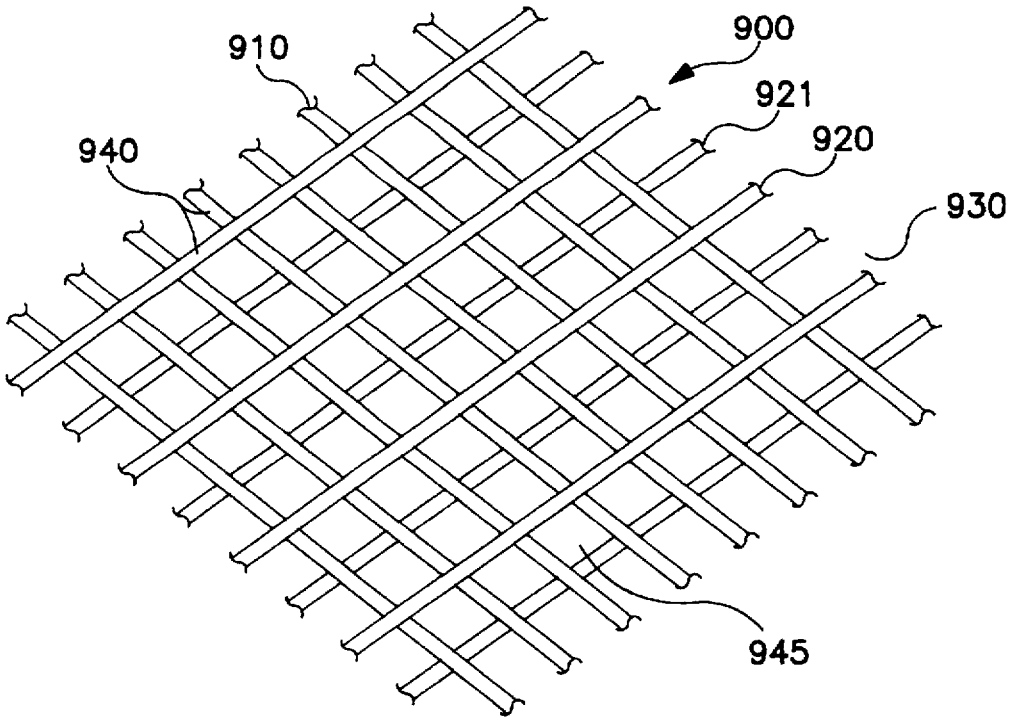
FIG. 9A is a perspective view of an adhesively secured, nonwoven fabric of the present invention.

FIG. 9A is a perspective view of an adhesively secured, open grid, scrim or nonwoven fabric 900 of the present invention. The fabric may be made by bringing machine direction and cross-machine direction rovings into contact with each other and holding them together while applying an adhesive polymeric resin which affixes the yarns together and provides the properties of hand and block resistance for use as a wall reinforcement. See for example the scrim machine referred to in U.S. Pat. No. 4,108,708. As in the weft inserted warp knit embodiment shown in FIG. 6A, the open grid fabric 900 essentially occupies three planes and the fabric is free from pinching of rovings of one set by rovings of the other. The warp or machine direction rovings 910 occupy and define one plane, and the weft or cross-machine direction rovings 920, 921 occupy and define two additional planes. These rovings have been direct-sized with at least a silane sizing. Also, open grid fabric 900 has no face. That is, its appearance is essentially the same on both sides.

In FIG. 9A, the open grid fabric 900 is locked together solely by polymeric resin 940, which confers properties to the reinforcement fabric such as stability, alkali resistance and strength improvement. Polymeric resin 940 is applied to the strands at a level of about 10% to 200% DPU (dry-weight pickup). The level of resin applied depends on the physical properties of the resin and is selected to assure the desired physical characteristics of the reinforcement, while assuring that openings 945 in the grid remain open. However, the level of resin coating in the adhesively secured embodiment is higher than that used in the woven and weft inserted warp knit embodiments. The most preferred resin amount to use is 10 to 80 DPU, and 10 to 120 DPU is less preferred. Weights of resin above 120 DPU are also possible, though economics becomes a factor when such large amounts are used.

The three-plane construction of the reinforcement of FIG. 9A reduces the pinching and the crimp or bending of the strands, which is an advantage over standard woven reinforcements.

For example, the construction of the fabric 900 may be an adhesively secured, nonwoven product having approximately 6 ends per inch in both the warp and weft directions, but possibly as few as 1.5 ends in each direction and as many as 12 ends in each direction. Preferably, the ends of the first and second sets are arranged in each set at an average of 3 to 10 ends per inch.

The warp and weft strands of the open grid fabric 900 may have a linear density of 5 to 4000 Tex (grams per thousand meters). Preferably, the strands of the first set and the second set have a linear density between 33 and 2200 Tex and most preferably, 130 to 400 Tex. However, the weight and strength of the strands selected depends on the performance range desired. Although fiberglass strands are preferred, others such as nylon, aramid, polyolefin and polyester may be used in various combinations.

In FIG. 9A, the ends of the first set 910 and the ends of the other sets 920, 921 are arranged in an overlying relation at a substantial angle to one another. This angle may be on the order of 90°. However, it is not necessary to orient the ends of the first and second sets orthogonally. Rather, this angle may vary between 60° and 120° or more.

Although not shown, tie yarns, as discussed above, could be used in conjunction with the fabric 900 of the present invention. Such lightweight tie yarns may add to the integrity of the fabric during manufacture, but would also add to the cost of the adhesively secured reinforcement.

Figure 9B:
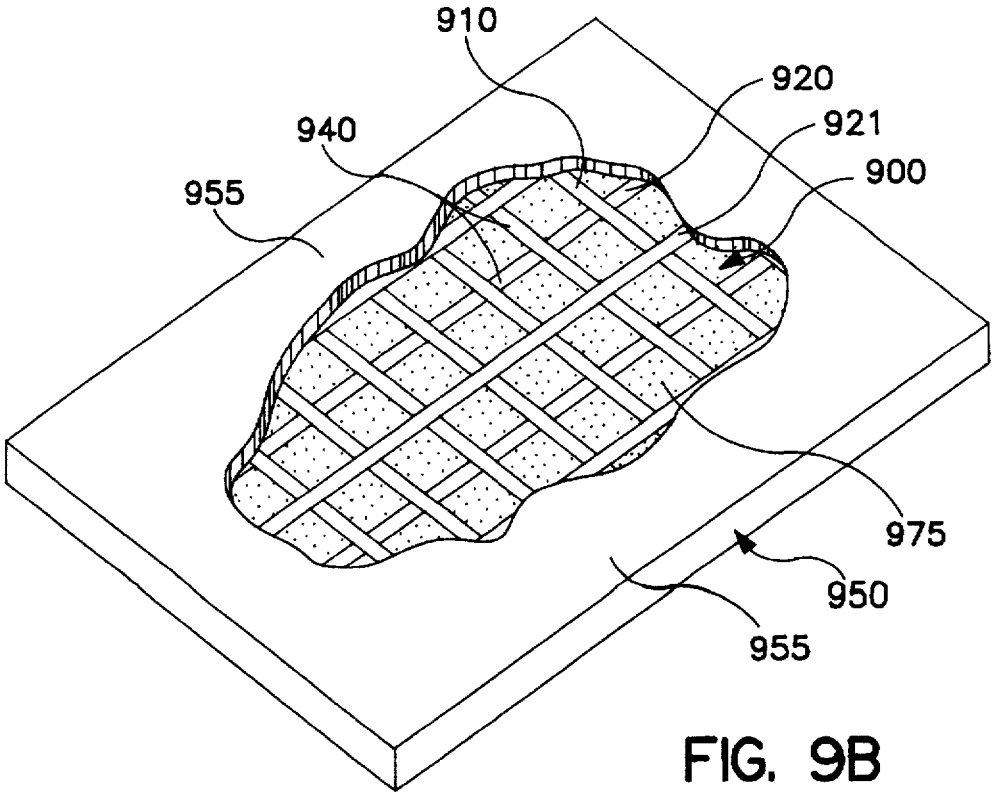
FIG. 9B is a perspective partial cut-away view of a wall segment produced using the adhesively secured, nonwoven fabric of the present invention.

FIG. 9B is a perspective partial cutaway view of wall segment 950 using the adhesively secured, nonwoven fabric 900. The open grid reinforcement fabric 900 is embedded in a stucco or stucco-like coating layer mixture 955. The coating mixture 955 is affixed to a rigid insulation board 975 by penetrating and filling the openings between the strands of the open grid to cover the reinforcement fabric 900 to form the wall segment product 950.

A specific example of a fabric of the present invention is a staggered leno weave, as shown in FIG. 6A, which uses rovings supplied by FiberglasCanada Inc. and designated 377 AA 275. 1137711 designates the direct-sized silane sizing of FiberglasCanada. "AA" is the product code for the roving. 275 is the Tex of the roving. These rovings are made from a glass type designated by Fiberglas (Canada) as ECR glass and have a filament diameter of about 13 microns. The tie yarn is 150 denier non-textured polyester and the coating is a polyvinylidene chloride resin from Rohm & Haas designated P-917.

The present invention has several advantages over current reinforcement fabrics, as represented by the following Table in which the first three columns refer to a reinforcements of the present invention, and the last column refers to a prior art wall reinforcement fabric:

TABLE

| Property | | (1) | (2) | (3) | (4) |
|---|---|---|---|---|---|
| Relative Cost | | 0.95 | 1.0 | 1.2 | 1.1–1.2 |
| Impact (in-lbs.) | | 32–36 | 32–36 | 32–36 | 12–16 |
| Ends/In, | MD | 6 | 6 | 5.5 | 6 |
| | CD | 5.5 | 5.5 | 5.5 | 6 |
| Area Wt. ($g/m^2$) | | 150 | 180 | 240 | 160 |
| Tensile | MD | 275 | 275 | 250–290 | 170–200 |
| (lbs/in) | CD | 315 | 315 | 280–320 | 230–260 |
| Hand | | SOFT | SOFT | SL. FIRM | SOFT |
| Block Resistance | | GOOD | GOOD | FAIR–GOOD | GOOD |

Column 1 above represents the most preferred embodiment of the present invention, leno weave fabrics with tie yarns, as shown in FIGS. 5 to 8. Column 2 is a weft inserted, warp knit fabric of the present invention, as shown in FIG. 4, which is the embodiment next in order of preference. Column 3 is a nonwoven, laid scrim of the present invention, as in FIG. 9. In columns 1 to 3, rovings, directed-sized with a silane sizing, are used in both the machine and the cross-machine directions. Column 4 is a conventional leno weave of oil/starch sized yarns in both the machine and cross-machine directions; that is, the machine direction yarns consist of a pair of equal weight yarns, as in FIGS. 1 and 2. If roving is substituted for the cross machine yarns of column 4, the cost goes down slightly, but performance remains about the same because the impact resistance would be determined by the weakest strands, which would be the starch sized pair of equal weight yarns in the machine direction.

In the Table "MD" refers to machine direction, i.e., warp. "CD" refers to cross-machine direction, i.e., weft. "Impact" refers to the pounds of impact the wall system will resist without significant denting in a standard test. "Area weight" is the weight of reinforcement yarns per unit area, including the polymeric resin. The term "ends" refers to a single strand or a group of strands combined together to make a single strand in the final grid. "Ends/In" refers to the number of ends per inch; in leno, hurl leno and some nonwoven fabrics, a single end may consist of two or more strands.

As shown by an analysis of the above results, reinforcement fabrics which are not made according to the present invention are inferior in at least one of the attributes noted above. Their designs may be slightly altered to improve one property, but it occurs at the expense of another. For example, the principal factor affecting both strength and cost is the weight of the strands and the number of strands per inch, which together result in an "area weight." The heavier the yarn or roving, the stronger the fabric, albeit at increased cost. Within any one construction type, those skilled in the art will find that additional processing variables may be altered to improve performance, but these additional variables do not have as much influence as the particular construction and sizing used. These additional variables include the filament diameter, type of strand, and the type, amount, and degree of penetration of the resin applied to the fabric after it is formed. We have found that these factors vary among the various construction types in the magnitude of their influence on impact resistance.

The processes and products described herein are representative and illustrative of ones which could be used to create various reinforcement fabrics and wall segments in accordance with the instant invention. The foregoing detailed description is therefore not intended to limit the scope of the present invention. Modifications and variations are contemplated, and the scope of the present invention is intended to be limited only by the accompanying claims.

What is claimed is:

1. A pre-coated open grid fabric wall reinforcement that reinforces and provides impact resistance to a wall system comprising a rigid surface and a stucco layer, the wall reinforcement comprising:

a first set of substantially parallel impact resistant rovings comprising an effective impact-resisting amount of a direct-sized silane sizing, having a linear density between 130 and 400 grams per thousand meters, and being arranged in the set at an average of 1.5 to 12 ends per inch;

a second set of substantially parallel impact resistant rovings comprising an effective impact-resisting amount of a direct-sized silane sizing, having a linear density between 130 and 400 grams per thousand meters, and being arranged in the set at an average of 1.5 to 12 ends per inch;

the first and second sets of rovings being arranged next to each other with the rovings of one set being arranged at a substantial angle to the rovings of the other set, without compressing rovings of one set between rovings of the other set, to form an open grid fabric wall reinforcement weighing between 50 and 650 gm/square meter to provide strength and impact resistance to the wall system; and an effective impact-resisting amount of polymeric coating on the rovings of the wall reinforcement at a level of 10 to 150 parts dry weight of resin to 100 parts by weight of the open grid fabric wall reinforcement, wherein the coating and the silane sizing are selected to assure that the wall reinforcement remains an open grid which permits the stucco-like layer to penetrate therethrough during fabrication of the wall system, that the wall reinforcement has pliability and body for application during fabrication of the wall system, and that the wall reinforcement imparts improved impact resistance to the wall system as compared to a wall system in the absence of a wall reinforcement comprising said rovings having said arrangement.

2. The wall reinforcement of claim 1, wherein the first and second sets of rovings are affixed together with tie yarn.

3. The wall reinforcement of claim 2, wherein the tie yarn is knit to the first and second sets of rovings at loose tension.

4. The wall reinforcement of claim 3, wherein the tension is at least about 3.1 yards of tie yarn for every 1 yard of ends in a warp direction.

5. The wall reinforcement of claim 2, in which the two sets of rovings are affixed together with a tie yarn in a staggered leno weaving process in which the tie yarns are arranged in pairs with rovings in one of the sets of rovings, and the tie yarns and the rovings are alternately twisted in a right hand and left hand direction crossing before weft roving is inserted.

6. The wall reinforcement of claim 2, in which the two sets of rovings are affixed together with a tie yarn in a hurl leno weaving process in which the tie yarns are arranged in pairs with rovings in one of the sets of rovings, and the tie yarns and the rovings are alternately twisted in a right hand and left hand direction crossing before weft roving is inserted.

7. The wall reinforcement of claim 2, in which the two sets of rovings are affixed together with a tie yarn in a staggered hurl weaving process in which the tie yarns are arranged in pairs with rovings in one of the sets of rovings, and the tie yarns and the rovings are alternately twisted in a right hand and left hand direction crossing before weft roving is inserted.

8. The wall reinforcement of claim 1, wherein the polymeric coating has a glass transition temperature between −40° C. to +40° C.

9. The wall reinforcement of claim 1, in which the polymeric coating is alkali and water resistant and is selected from the group consisting of polyvinyl chloride, polyvinylidene chloride, styrene butadiene rubber, urethane, silicone, acrylic and styrene acrylate polymers and copolymers, and the coating is applied at a level of 5 to 40 parts dry weight of resin to 100 parts by weight of fabric wall reinforcement.

10. The wall reinforcement of claim 1, wherein the first and second sets of rovings are selected from the group consisting of fiberglass, nylon, aramid, polyolefin and polyester.

11. The wall reinforcement of claim 1, wherein the first set of rovings and the second set of rovings are arranged at an average of 3 to 10 strands per inch.

12. The wall reinforcement of claim 1, in which each set of rovings lies essentially in its own plane.

13. The wall reinforcement of claim 1, in which the rovings are direct-sized with a silane sizing that consists essentially of silane sizing.

14. A pre-coated open grid fabric wall reinforcement that reinforces and provides impact resistance to a wall system comprising a rigid surface and a stucco layer, the wall reinforcement comprising:

a first set of substantially parallel strength-imparting rovings comprising an effective strength-imparting amount of a direct-sized silane sizing, having a linear density between 130 and 400 grams per thousand meters, and being arranged in the set at an average of 1.5 to 12 ends per inch;

a second set of substantially parallel strength-imparting rovings comprising an effective strength-imparting amount of a direct-sized silane sizing, having a linear density between 130 and 400 grams per thousand meters, and being arranged in the set at an average of 1.5 to 12 ends per inch;

the first and second sets of rovings being arranged next to each other with the rovings of one set being arranged at a substantial angle to the rovings of the other set, without compressing rovings of one set between rovings of the other set, to form an open grid fabric wall reinforcement weighing between 50 and 650 gm/square meter to provide strength and impact resistance to the wall system; and an effective strength-imparting amount of polymeric coating on the rovings of the wall reinforcement at a level of 10 to 150 parts dry weight of resin to 100 parts by weight of the open grid fabric wall reinforcement, wherein the coating and the silane sizing are selected to assure that the wall reinforcement remains an open grid which permits the stucco-like layer to penetrate therethrough during fabrication of the wall system, that the wall reinforcement has pliability and body for application during fabrication of the wall system, and that the wall reinforcement imparts improved strength to the wall system as compared to a wall system in the absence of a wall reinforcement comprising said rovings having said arrangement.

15. The wall reinforcement of claim 14, wherein the first and second sets of rovings are affixed together with tie yarn.

16. The wall reinforcement of claim 15, wherein the tie yarn is knit to the first and second sets of rovings at loose tension.

17. The wall reinforcement of claim 16, wherein the tension is at least about 3.1 yards of tie yarn for every 1 yard of ends in a warp direction.

18. The wall reinforcement of claim 16, in which the two sets of rovings are affixed together with a tie yarn in a staggered leno weaving process in which the tie yarns are arranged in pairs with rovings in one of the sets of rovings, and the tie yarns and the rovings are alternately twisted in a right hand and left hand direction crossing before weft roving is inserted.

19. The wall reinforcement of claim 15, in which the two sets of rovings are affixed together with a tie yarn in a hurl leno weaving process in which the tie yarns are arranged in pairs with rovings in one of the sets of rovings, and the tie yarns and the rovings are alternately twisted in a right hand and left hand direction crossing before weft roving is inserted.

20. The wall reinforcement of claim 15, in which the two sets of rovings are affixed together with a tie yarn in a staggered hurl weaving process in which the tie yarns are arranged in pairs with rovings in one of the sets of rovings, and the tie yarns and the rovings are alternately twisted in a right hand and left hand direction crossing before weft roving is inserted.

21. The wall reinforcement of claim 14, wherein the polymeric coating has a glass transition temperature between −40° C. to +40° C.

22. The wall reinforcement of claim 14, in which the polymeric coating is alkali and water resistant and is selected from the group consisting of polyvinyl chloride, polyvinylidene chloride, styrene butadiene rubber, urethane, silicone, acrylic and styrene acrylate polymers and copolymers, and the coating is applied at a level of 5 to 40 parts dry weight of resin to 100 parts by weight of fabric wall reinforcement.

23. The wall reinforcement of claim 14, wherein the first and second sets of rovings are selected from the group consisting of fiberglass, nylon, aramid, polyolefin and polyester.

24. The wall reinforcement of claim 14, wherein the first set of rovings and the second set of rovings are arranged at an average of 3 to 10 strands per inch.

25. The wall reinforcement of claim 14, in which each set of rovings lies essentially in its own plane.

26. The wall reinforcement of claim 14, in which the rovings are direct-sized with a silane sizing that consists essentially of silane sizing.

27. A pre-coated open grid fabric wall reinforcement that reinforces and provides impact resistance to a wall system comprising a rigid surface and a stucco layer, the wall reinforcement comprising:

a first set of substantially parallel impact resistant and strength-imparting rovings comprising an effective impact-resisting and strength-imparting amount of a direct-sized silane containing sizing, having a linear density between 130 and 400 grams per thousand meters, and being arranged in the set at an average of 1.5 to 12 ends per inch;

a second set of substantially parallel impact resistant and strength imparting rovings comprising an effective impact-resisting and strength-imparting amount of a direct-sized silane containing sizing, having a linear density between 130 and 400 grams per thousand meters, and being arranged in the set at an average of 1.5 to 12 ends per inch;

the first and second sets of rovings being arranged next to each other with the rovings of one set being arranged at a substantial angle to the rovings of the other set, without compressing rovings of one set between rovings of the other set, to form an open grid wall reinforcement fabric weighing between 50 and 650 gm/square meter to provide strength and impact resistance to the wall system; and an effective strength-imparting amount of polymeric coating on the rovings of the wall reinforcement at a level of 10 to 150 parts dry weight of resin to 100 parts by weight of the open grid fabric wall reinforcement, wherein the coating and the silane containing sizing are selected to assure that the wall reinforcement remains an open grid which permits the stucco layer to penetrate therethrough during fabrication of the wall system, that the wall reinforcement has pliability and body for application during fabrication of the wall system, and that the wall reinforcement imparts improved impact resistance and strength to the wall system as compared to a wall system in the absence of a wall reinforcement comprising said rovings having said arrangement.

* * * * *